US007931727B2

(12) United States Patent
Gonze et al.

(10) Patent No.: US 7,931,727 B2
(45) Date of Patent: Apr. 26, 2011

(54) MICROWAVE MODE SHIFTING ANTENNA SYSTEM FOR REGENERATING PARTICULATE FILTERS

(75) Inventors: Eugene V. Gonze, Pinckney, MI (US); Michael J. Paratore, Jr., Howell, MI (US); Kevin W. Kirby, Calabasas Hills, CA (US); Amanda Phelps, Malibu, CA (US); Daniel J. Gregoire, Thousand Oaks, CA (US)

(73) Assignee: GM Global Technology Operations, Inc.

( * ) Notice: Subject to any disclaimer, the term of this patent is extended or adjusted under 35 U.S.C. 154(b) by 393 days.

(21) Appl. No.: 11/972,952

(22) Filed: Jan. 11, 2008

(65) Prior Publication Data

US 2009/0071110 A1 Mar. 19, 2009

Related U.S. Application Data

(60) Provisional application No. 60/972,872, filed on Sep. 17, 2007.

(51) Int. Cl.
*B01D 39/00* (2006.01)
*B01D 39/14* (2006.01)
*B01D 39/06* (2006.01)

(52) U.S. Cl. ..... 55/523; 55/522; 55/524; 55/282.3

(58) Field of Classification Search ..... 55/522–524, 55/282.3

See application file for complete search history.

(56) References Cited

U.S. PATENT DOCUMENTS

| | | | | |
|---|---|---|---|---|
| 4,042,879 | A * | 8/1977 | Ho et al. | 324/636 |
| 4,505,726 | A | 3/1985 | Takeuchi | |
| 4,516,993 | A | 5/1985 | Takeuchi | |
| 5,087,272 | A * | 2/1992 | Nixdorf | 95/20 |
| 5,367,139 | A * | 11/1994 | Bennett et al. | 219/121.59 |
| 5,423,180 | A * | 6/1995 | Nobue et al. | 60/274 |
| 6,176,896 | B1 * | 1/2001 | Dementhon et al. | 95/14 |
| 6,322,605 | B1 * | 11/2001 | He et al. | 55/523 |
| 6,323,470 | B2 * | 11/2001 | Schmidt et al. | 219/679 |
| 7,138,615 | B1 * | 11/2006 | Williamson et al. | 219/679 |
| 7,303,602 | B2 * | 12/2007 | Gregoire et al. | 55/282.3 |
| 2002/0069756 | A1 * | 6/2002 | Mako et al. | 95/148 |
| 2002/0092422 | A1 * | 7/2002 | Ament et al. | 95/148 |
| 2006/0101793 | A1 * | 5/2006 | Gregoire et al. | 55/282.3 |
| 2006/0101794 | A1 * | 5/2006 | Gregoire et al. | 55/282.3 |
| 2007/0028765 | A1 * | 2/2007 | Gonze et al. | 95/11 |

FOREIGN PATENT DOCUMENTS

| | | |
|---|---|---|
| CN | 1066486 | 11/1992 |
| CN | 1547501 | 11/2004 |
| EP | 0635625 | 1/1995 |

* cited by examiner

*Primary Examiner* — Walter D Griffin
*Assistant Examiner* — Amber Orlando

(57) ABSTRACT

A regeneration system comprises a particulate matter (PM) filter including a microwave energy absorbing surface, and an antenna system comprising N antennas and an antenna driver module that sequentially drives the antenna system in a plurality of transverse modes of the antenna system to heat selected portions of the microwave absorbing surface to regenerate the PM filter, where N is an integer greater than one. The transverse modes may include transverse electric (TE) and/or transverse magnetic (TM) modes.

18 Claims, 5 Drawing Sheets

MICROWAVE MODE SHIFTING ANTENNA SYSTEM FOR REGENERATING PARTICULATE FILTERS

CROSS-REFERENCE TO RELATED APPLICATIONS

This application claims the benefit of U.S. Provisional Patent Application No. 60/972,872, filed on Sep. 17, 2007. The disclosure of the above application is incorporated herein by reference in its entirety.

STATEMENT OF GOVERNMENT RIGHTS

This disclosure was produced pursuant to U.S. Government Contract No. DE-FC-04-03 AL67635 with the Department of Energy (DoE). The U.S. Government has certain rights in this disclosure.

FIELD

The present disclosure relates to particulate matter (PM) filters, and more particularly to regenerating PM filters.

BACKGROUND

The statements in this section merely provide background information related to the present disclosure and may not constitute prior art.

Engines such as diesel engines produce particulate matter (PM) that is filtered from exhaust gas by a PM filter. The PM filter is disposed in an exhaust system of the engine. The PM filter reduces emission of PM that is generated during combustion.

Over time, the PM filter becomes full. During regeneration, the PM may be burned within the PM filter. Regeneration may involve heating the PM filter to a combustion temperature of the PM. There are various ways to perform regeneration including modifying engine management, using a fuel burner, using a catalytic oxidizer to increase the exhaust temperature with after injection of fuel, using resistive heating coils, and/or using microwave energy. The resistive heating coils are typically arranged in contact with the PM filter to allow heating by both conduction and convection.

Diesel PM combusts when temperatures above a combustion temperature such as 600° C. are attained. The start of combustion causes a further increase in temperature. While spark-ignited engines typically have low oxygen levels in the exhaust gas stream, diesel engines have significantly higher oxygen levels. While the increased oxygen levels make fast regeneration of the PM filter possible, it may also pose some problems.

PM reduction systems that use fuel tend to decrease fuel economy. For example, many fuel-based PM reduction systems decrease fuel economy by 5%. Electrically heated PM reduction systems reduce fuel economy by a negligible amount. However, durability of the electrically heated PM reduction systems has been difficult to achieve.

SUMMARY

A regeneration system comprises a particulate matter (PM) filter including a microwave energy absorbing surface, and an antenna system comprising N antennas and an antenna driver module that sequentially drives said antenna system a plurality of transverse modes of said antenna system to heat selected portions of said microwave absorbing surface, where N is an integer greater than one.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
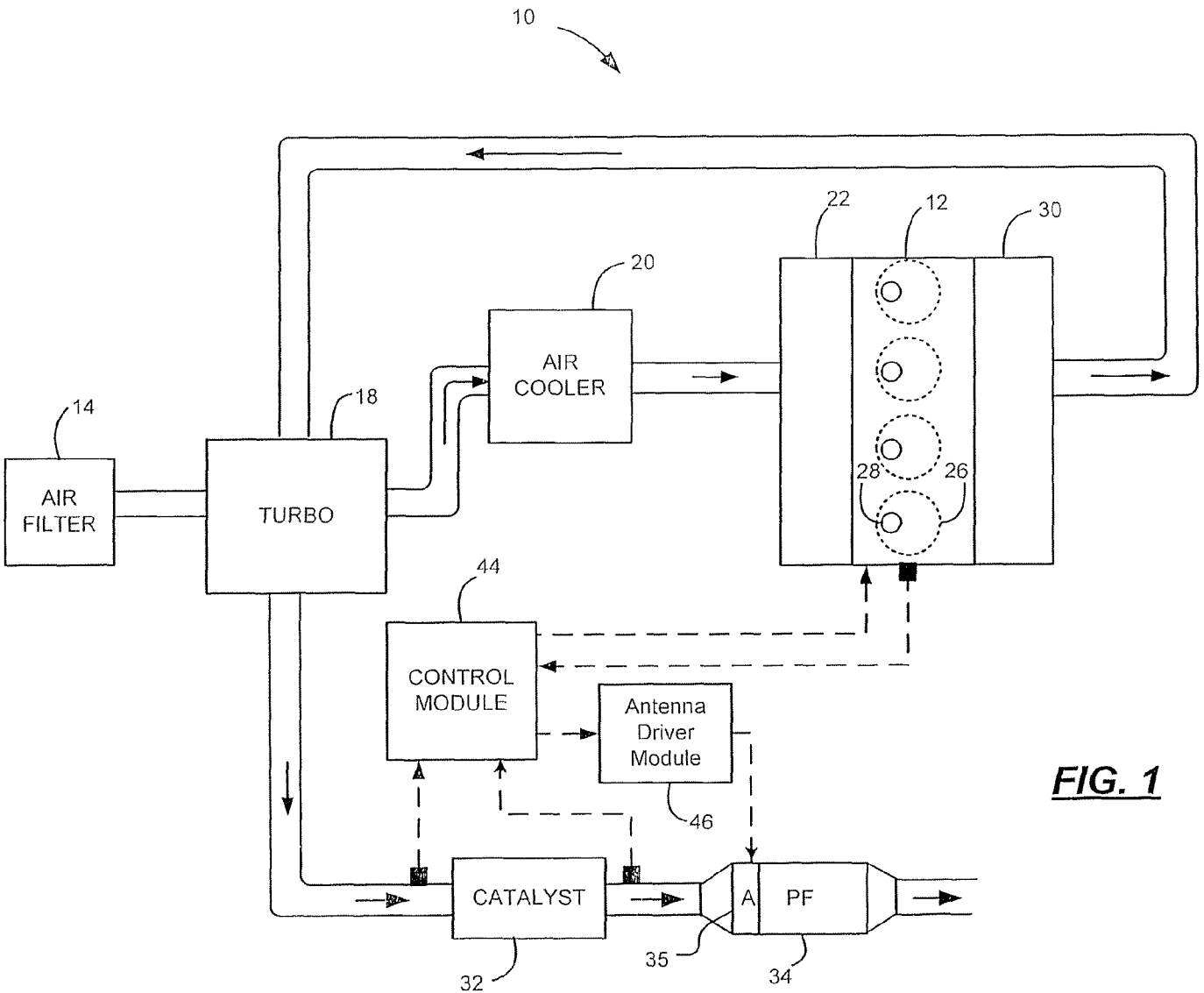
FIG. 1 is a functional block diagram of an exemplary engine system including a particulate matter (PM) filter and an antenna system.

The following description is merely exemplary in nature and is not intended to limit the present disclosure, application, or uses. It should be understood that throughout the drawings, corresponding reference numerals indicate like or corresponding parts and features.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

According to the present disclosure, the PM filter is regenerated by selectively activating different transverse electric (TE) and/or transverse magnetic (TM) modes of an antenna system to wirelessly ignite soot in the PM filter. The PM filter may include a microwave absorbing surface on a front face. The front face is exposed to microwave radiation from the antenna. When a sufficient face temperature is reached, the antenna system is turned off and the burning soot cascades down the length of the PM filter channel, which is similar to a burning fuse on a firework.

In other words, the antenna system may be activated long enough to start the soot ignition. Then, the antenna system may be shut off. The burning soot is the fuel that continues the regeneration. This process is continued for each zone until the PM filter is completely regenerated.

The different TE and/or TM modes of the antenna system heat different portions of the microwave absorbing surface. As a result, different zones in the PM filter are regenerated and thermal stress due to heating is smaller and more evenly distributed. The TE and/or TM modes and heated zones may be partially overlapping or non-overlapping.

Referring now to FIG. 1, an exemplary diesel engine system 10 is schematically illustrated in accordance with the present disclosure. It is appreciated that the diesel engine system 10 is merely exemplary in nature and that the regeneration system described herein can be implemented in various engine systems implementing a particulate filter. Such engine systems may include, but are not limited to, gasoline direct injection engine systems and homogeneous charge compression ignition engine systems. For ease of the discussion, the disclosure will be discussed in the context of a diesel engine system.

A turbocharged diesel engine system 10 includes an engine 12 that combusts an air and fuel mixture to produce drive torque. Air enters the system by passing through an air filter 14. Air passes through the air filter 14 and is drawn into a turbocharger 18. The turbocharger 18 compresses the fresh air entering the system 10. The greater the compression of the air generally, the greater the output of the engine 12. Compressed air then passes through an air cooler 20 before entering into an intake manifold 22.

Air within the intake manifold 22 is distributed into cylinders 26. Although four cylinders 26 are illustrated, the systems and methods of the present disclosure can be implemented in engines having a plurality of cylinders including, but not limited to, 2, 3, 4, 5, 6, 8, 10 and 12 cylinders. It is also appreciated that the systems and methods of the present disclosure can be implemented in a V-type cylinder configuration. Fuel is injected into the cylinders 26 by fuel injectors 28. Heat from the compressed air ignites the air/fuel mixture. Combustion of the air/fuel mixture creates exhaust. Exhaust exits the cylinders 26 into the exhaust system.

The exhaust system includes an exhaust manifold 30, a diesel oxidation catalyst (DOC) 32, and a particulate filter (PM filter) assembly 34 with an antenna system 35. Optionally, an EGR valve (not shown) re-circulates a portion of the exhaust back into the intake manifold 22. The remainder of the exhaust is directed into the turbocharger 18 to drive a turbine. The turbine facilitates the compression of the fresh air received from the air filter 14. Exhaust flows from the turbocharger 18 through the DOC 32, through the antenna system 35 and into the PM filter assembly 34. The DOC 32 oxidizes the exhaust based on the post combustion air/fuel ratio. The amount of oxidation increases the temperature of the exhaust. The PM filter assembly 34 receives exhaust from the DOC 32 and filters soot particulates present in the exhaust.

A control module 44 controls the engine and PM filter regeneration based on various sensed information. More specifically, the control module 44 estimates loading of the PM filter assembly 34. When the estimated loading is at a predetermined level and the exhaust flow rate is within a desired range, the control module 44 may activate the antenna driver module 46. The antenna driver mode 46 cycles through a plurality of antenna driving modes to initiate heating in various zones of the PM filter as will be described below.

Figure 2:
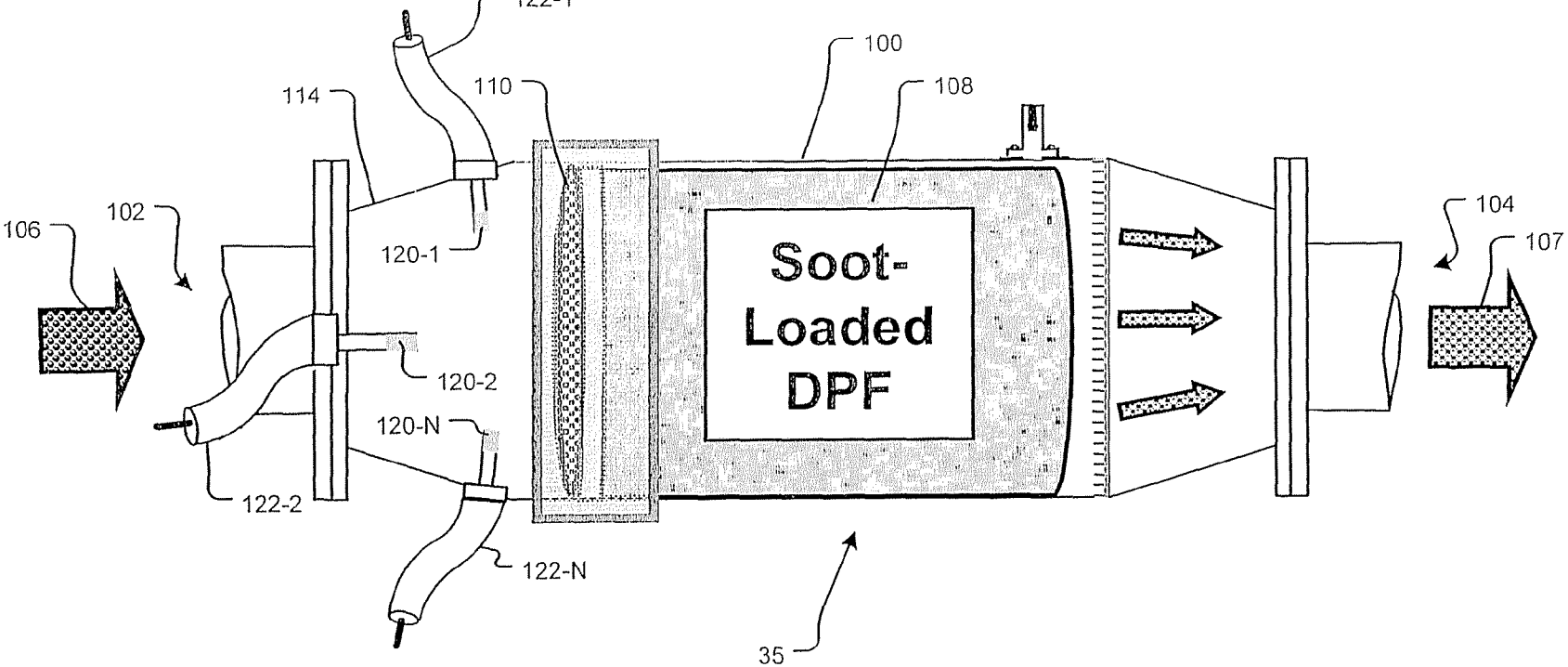
FIG. 2 is a more detailed functional block diagram of a PM filter with an antenna system according to the present disclosure.

Referring now to FIG. 2, the PM filter 35 includes a housing 100 having an inlet 102 and an outlet 104. Exhaust gas enters the inlet 100 at 106 and exits the outlet 104 at 107 after being filtered by filter media 108. Soot builds up in the filter media 108. The PM filter includes a microwave absorbing surface 110 arranged adjacent to a front face of the filter media 108. The microwave absorbing surface may include a screen-like surface with a microwave absorbing coating.

An inlet housing portion 114 defines a resonant cavity having a geometry and size that facilitates standing waves with different transverse electric (TE) and/or transverse magnetic (TM) modes. An antenna system comprises N antennas 120-1, 120-2, . . . and 120-N (collectively 120) that are arranged inside of the inlet housing portion 114 where N is an integer greater than one. For example only, N can be equal to 3.

Conductors 122-1, 122-2, . . . and 122-N communicate with the antenna driver module 46. The antenna driver module 46 selects the number of antennas and adjusts power levels, and excitation frequencies of each of the antennas 120 to alter the TE and/or TM mode. For example only, different combinations of antennas may be on or off depending upon the mode. By altering the TE and/or TM modes, heating and regeneration takes place in different zones of the PM filter.

In other words, the present disclosure uses multiple microwave input sources to create standing waves with different TE and/or TM modes based on the microwave source location, shape of the PM filter housing, and the microwave absorber strength. By coordinating the geometry of the inlet housing portion with the position of the antennas, resonance at the chosen microwave frequency may be attained within the cavity. Each mode may include high and low field intensity, which acts likes individual heating zones. The microwave absorbing surface 110 may be arranged or coated on the front of the PM filter. The heating pattern of the antenna mode ignites the soot on the front of the PM filter. The flamefront then burns down the filter channel cleaning the PM filter. Subsequently, a different antenna mode having a different pattern may be used.

Figure 3:
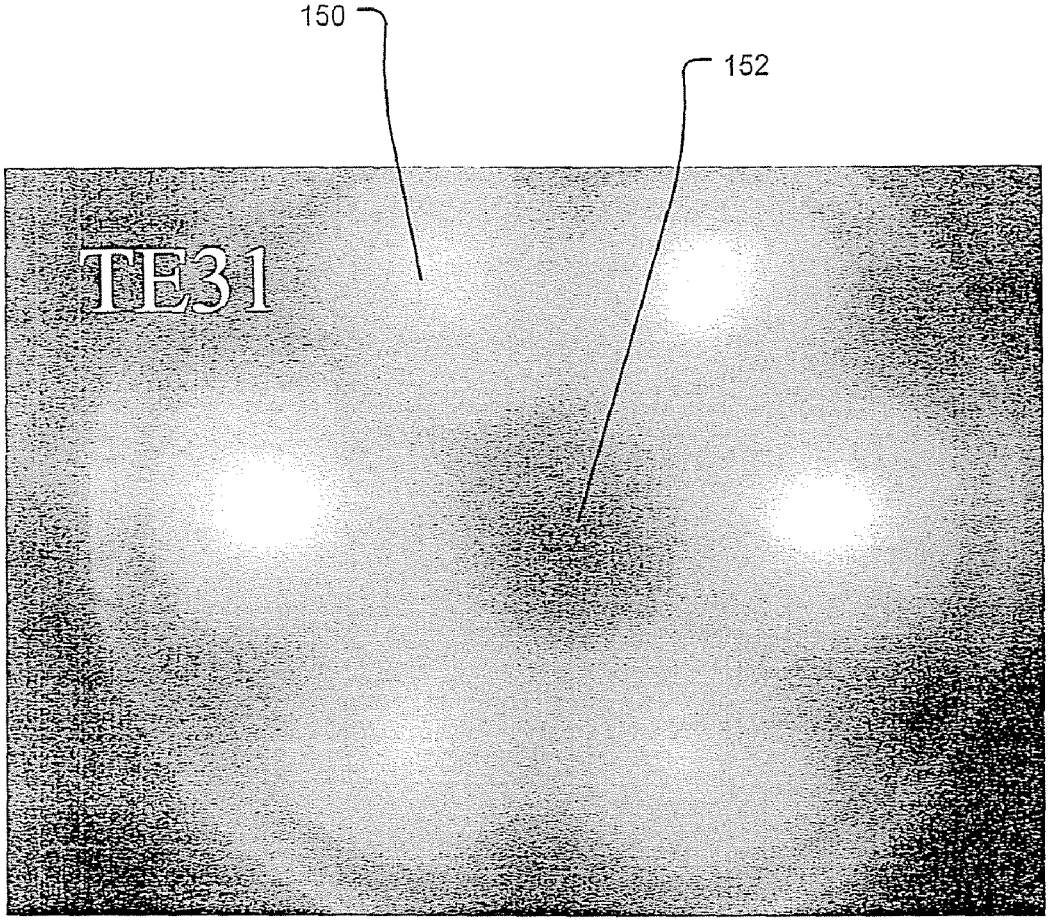
FIG. 3 illustrates heating of a microwave absorbing surface in one antenna TE mode.
Figure 4:
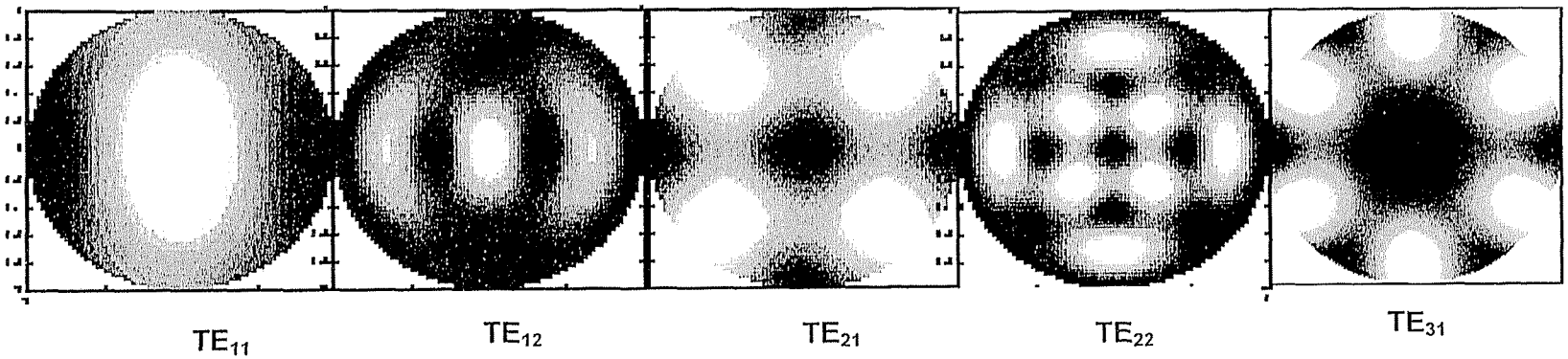
FIG. 4 illustrates heating of a microwave absorbing surface in other antenna TE modes.

Referring now to FIGS. 3 and 4, various TE modes are shown on the microwave absorber 110. In FIG. 3, a TE31 mode is shown. Bright areas 150 represent high heating while dark areas are not heated or not heated as much. Areas in between bright areas 150 and dark areas 152 represent temperatures therebetween. In FIG. 4, other TE modes are shown. As can be appreciated, TM modes may be used in addition to or instead of the TE modes.

Figure 5:
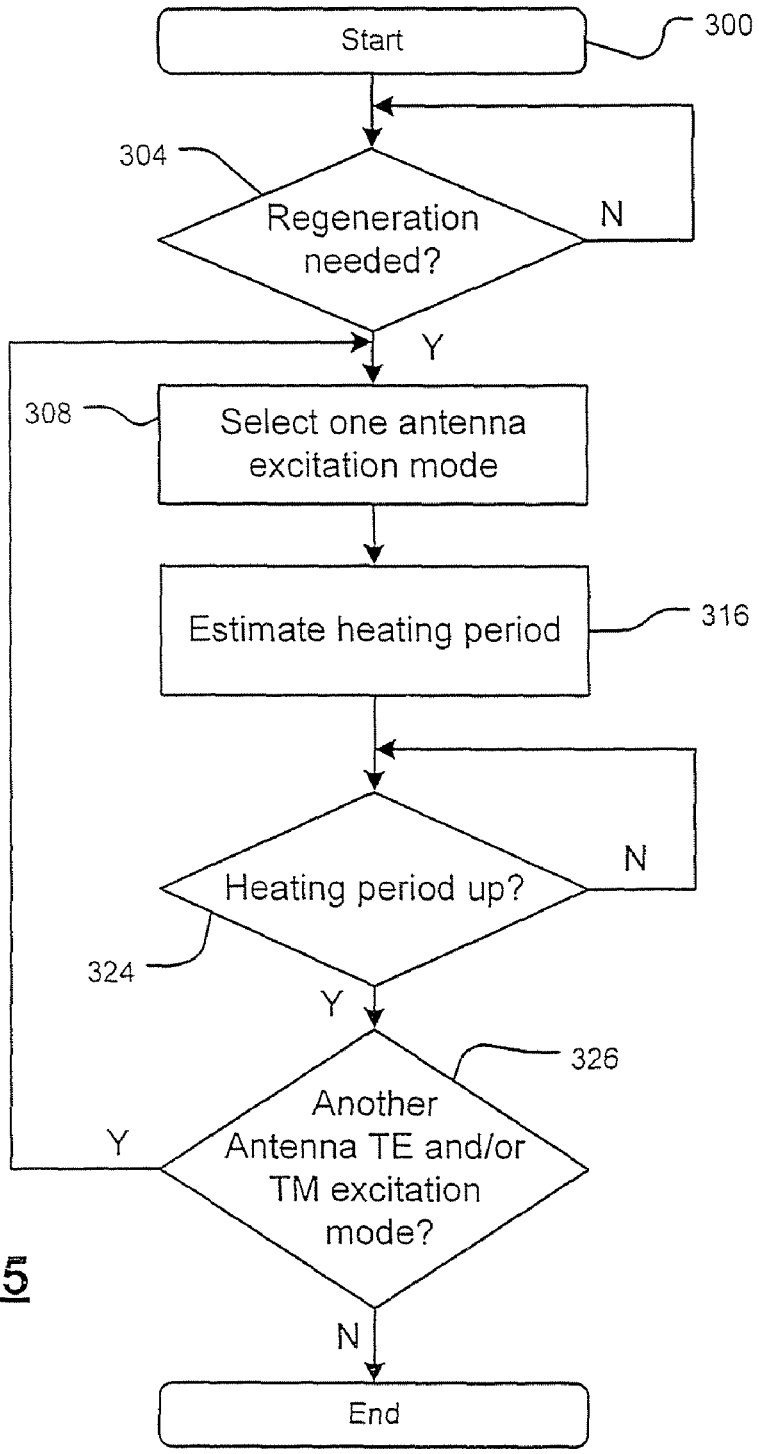
FIG. 5 is a flowchart illustrating regeneration of PM filter zones using multiple TE and/or TM modes of the antenna system.

Referring now to FIG. 5, steps for regenerating the PM filter are shown. In step 300, control begins and proceeds to step 304. If control determines that regeneration is needed in step 304, control selects an antenna excitation mode in step 308. In step 316, control estimates a heating period sufficient to achieve a minimum filter face temperature based exhaust flow, oxygen level, signal power, frequency and/or excitation duration. The minimum face temperature may be sufficient to start the soot burning and to create a cascading effect. For example only, the minimum face temperature may be set to 700 degrees Celsius or greater.

In step 324, control determines whether the heating period is up. The heating period may depend upon the particular mode that is selected. If step 324 is true, control determines whether additional antenna excitation modes need to be activated in step 326. If step 326 is true, control returns to step 308. Otherwise control ends.

In use, the N microwave antennas are integrated in the housing or cavity containing a soot-loaded PM filter with a microwave absorbing surface or coating on the front face. The frequency of each microwave source may be the same or different. By coordinating the geometry of the housing with the position of the N antennas and the PM filter, resonance for the chosen microwave frequency may be attained within the cavity. Depending on which combination of the three microwave sources are activated, the resonance condition provides a dominant mode. Each mode includes regions of high and low field intensities.

Examples of several transverse electric field (TE) modes are shown in the FIG. 4. When incident on the face of the coated PM filter, the high field intensity regions of the mode result in heating, while low field regions do not. In FIG. 3, selective heating of the front face of a coated PM filter is shown in the TE31 mode. By shifting to another allowed mode (i.e. TE11), through the use of a different combination of active antennas, a separate zone of the DPF face may be sequentially heated to initiate a regeneration event. Similar effects can be achieved with TM modes and/or a combination of TM and TE modes.

What is claimed is:

1. A regeneration system comprising:

a housing that comprises an upstream end for receiving exhaust gas and a downstream end;

a particulate matter (PM) filter arranged in said housing and including a microwave energy absorbing surface;

an antenna system comprising N antennas at least partially arranged in said housing, wherein each of said N antennas directs microwave energy directly onto a common face of said microwave energy absorbing surface, where N is an integer greater than two; and an antenna driver module that sequentially drives said antenna system in a plurality of different transverse modes of said antenna system to heat selected portions of said microwave energy absorbing surface during a regeneration event, wherein at least one of said plurality of different transverse modes of said antenna system utilizes less than all of said N antennas during said regeneration event and at least another one of said plurality of different transverse modes of said antenna system utilizes all of said N antennas during said regeneration event.

2. The regeneration system of claim 1 further comprising a control module that determines when regeneration is needed and that selectively initiates regeneration using said antenna driver module when said regeneration is needed.

3. The regeneration system of claim 1 wherein said antenna driver module switches between said transverse modes of said antenna system to regenerate M zones within said PM filter, where M is an integer greater than one.

4. The regeneration system of claim 1 wherein N is equal to 3.

5. The regeneration system of claim 1 wherein said different transverse modes include a transverse electric (TE) mode.

6. The regeneration system of claim 1 wherein said different transverse modes include a transverse magnetic (TM) mode.

7. A regeneration system comprising:

a particulate matter (PM) filter including a microwave energy absorbing surface; and an antenna system comprising:

N antennas, wherein each of said N antennas directs microwave energy directly onto a common face of said microwave energy absorbing surface, where N is an integer greater than two; and an antenna driver module that sequentially drives said antenna system in a plurality of different transverse modes of said antenna system to heat selected portions of said microwave energy absorbing surface during a regeneration event, wherein at least one of said plurality of different transverse modes of said antenna system utilizes less than all of said N antennas during said regeneration event and at least another one of said plurality of different transverse modes of said antenna system utilizes all of said N antennas during said regeneration event.

8. The regeneration system of claim 7 further comprising a control module that initiates regeneration using said antenna driver module when regeneration is needed.

9. The regeneration system of claim 7 wherein said antenna driver module switches between said different transverse modes of said antenna system to regenerate M zones within said PM filter, where M is an integer greater than one.

10. The regeneration system of claim 7 wherein N is equal to 3.

11. The regeneration system of claim 7 wherein said different transverse modes include a transverse electric (TE) mode.

12. The regeneration system of claim 7 wherein said different transverse modes include a transverse magnetic (TM) mode.

13. A method for regenerating a particulate matter (PM) filter comprising:

arranging the PM filter in a housing, wherein the PM filter includes a microwave absorbing surface;

arranging an antenna system comprising N antennas at least partially in said housing, wherein each of said N antennas directs microwave energy directly onto a common face of said microwave energy absorbing surface, where N is an integer greater than two; and sequentially driving said antenna system in a plurality of different transverse modes of said antenna system during a regeneration event to heat selected portions of said microwave energy absorbing surface, where N is an integer greater than one, wherein at least one of said plurality of different transverse modes of said antenna system utilizes less than all of said N antennas during said regeneration event and at least another one of said plurality of different transverse modes of said antenna system utilizes all of said N antennas during said regeneration event.

14. The method of claim 13 further comprising:

determining when regeneration is needed; and selectively initiating regeneration using said antenna system when said regeneration is needed.

15. The method of claim 13 further comprising switching between said transverse modes of said antenna system to regenerate M zones within said PM filter, where M is an integer greater than one.

16. The method of claim 13 wherein N is equal to 3.

17. The method of claim 13 wherein said transverse modes include a transverse electric (TE) mode.

18. The method of claim 13 wherein said transverse modes include a transverse magnetic (TM) mode.

* * * * *